US005581053A

United States Patent [19]

Suzuki et al.

[11] Patent Number: 5,581,053

[45] Date of Patent: Dec. 3, 1996

[54] DIAPHRAGM OF ELECTROACOUSTIC TRANSDUCER AND METHOD OF MANUFACTURING THE SAME

[75] Inventors: Akihisa Suzuki, Higashihiroshima; Yukimi Hiroshima, Hiroshima; Kunihiko Ohbayashi, Higashihiroshima, all of Japan

[73] Assignee: Sharp Kabushiki Kaisha, Osaka-fu, Japan

[21] Appl. No.: 476,573

[22] Filed: Jun. 7, 1995

Related U.S. Application Data

[63] Continuation of Ser. No. 229,434, Apr. 12, 1994, abandoned, which is a continuation of Ser. No. 845,040, Mar. 3, 1992, abandoned.

[30] Foreign Application Priority Data

Mar. 11, 1991 [JP] Japan ..... 3-043903

[51] Int. Cl.[6] ..... G10K 13/00

[52] U.S. Cl. ..... 181/167; 181/169

[58] Field of Search ..... 181/167, 169, 181/173; 428/260, 265, 272; 156/62.2

[56] References Cited

U.S. PATENT DOCUMENTS 3,935,924 2/1976 Nagao et al. ..... 181/169
5,057,166 10/1991 Young, Sr. et al. ..... 156/62.2

FOREIGN PATENT DOCUMENTS 0037738 6/1978 Japan ..... 181/169

*Primary Examiner*—Khanh Dang
*Attorney, Agent, or Firm*—Birch, Stewart, Kolasch & Birch, LLP

[57] ABSTRACT

A diaphragm of an electroacoustic transducer is made of a material including fibers taken out of young stems of bamboo grasses and preferably, used as the material is paper made by mixing the fibers taken out of young stems of bamboo grasses and wood pulp in a predetermined ratio. Containing fibers taken out of young stems of bamboo grasses allows rigidity and internal loss characteristics of the diaphragm to be enhanced without increasing its density, thereby expanding a frequency band of the diaphragm. In addition, young stems of bamboo grasses can be gathered without affecting parent bamboo grasses, which prevents destruction of the environment.

6 Claims, 3 Drawing Sheets

FIBER OF WOOD PULP

FIBER OF YOUNG STEM OF "CHISHIMA SASA"

DIAPHRAGM OF ELECTROACOUSTIC TRANSDUCER AND METHOD OF MANUFACTURING THE SAME

This application is a continuation of application Ser. No. 08/229,434 filed on Apr. 12, 1994, now abandoned, which is a continuation of application Ser. No. 07/845,040, filed Mar. 3, 1992, now abandoned.

BACKGROUND OF THE INVENTION

1. Field of the Invention

The present invention relates to a diaphragm of an electroacoustic transducer and a method of manufacturing the same, and more particularly, to materials for a diaphragm of high characteristic speaker with highly balanced internal loss, density and rigidity and a method of manufacturing such diaphragm.

2. Background Art

Various materials have been developed as materials for a diaphragm of an electrodynamic type speaker, for example, for use in conventional audio equipments. Among such materials, typical properties of matter of a diaphragm made of wood pulp, for example, include a density of 0.485, Young's Modulus of $1.17\times10^{10}$ dyn/cm$^2$ and internal loss of 0.0714. In general, essential requirements of a material for a diaphragm of such speaker are a small density, high rigidity and large internal loss.

The outline of a relationship between properties of matter of a material for a diaphragm and characteristics of the diaphragm is as described in the following. First, as a density is reduced, a reproducing sound pressure level of the speaker is increased. With an increase in rigidity, a reproducing band of the speaker is expanded, particularly to a high frequency side. In addition, the larger the internal loss becomes, the lower high frequency peak in a reproducing band of the speaker can be brought down to.

To properly meet the above-described three requirements of properties of matter, such diaphragm materials have been conventionally developed as including substances of high rigidity such as carbon fiber and aramid fiber and as having large internal loss such as propylene.

Increasing rigidity of a diaphragm results in a decrease in internal loss and increase in a density. In addition, increasing internal loss tends to cause a reduction in rigidity and an increase in a density.

Highly balancing the above-described three properties of matter to each other is therefore important to make cone paper to be made into a diaphragm of a speaker.

Among the conventional materials of a diaphragm, aluminum has a density of 0.7, Young's Modulus of $62\times10^{10}$ dyn/cm$^2$ and internal loss of 0.002, while polypropylene has a density of 0.91, Young's Modulus of $1.08\times10^{10}$ dyn/cm$^2$ and internal loss of 0.07.

A diaphragm made of wood pulp having adequately large internal loss and a small density, has an advantage of a narrow frequency band due to lack of rigidity. Producing wood pulp requires deforesting. Restoring forest after deforesting needs great cost and a long period of time.

In a case of a diaphragm made of wood pulp, making a high quality diaphragm out of wood pulp including entangled fibers necessitates a process of beating wood pulp immersed in water for a long time. In other words, beating the wood pulp in water disentangles fiber bundles into fibers of moderate length, which fibers are swelled and torn lengthwise to be easily entangled. Since making of wood pulp requires a process of beating the pulp in water as described in the foregoing, it takes much labor to manufacture such pulp.

SUMMARY OF THE INVENTION

An object of the present invention is to provide a diaphragm of a high characteristic speaker with highly balanced internal loss, a density and rigidity and a method of manufacturing such diaphragm.

Another object of the present invention is to provide materials for a diaphragm of a speaker which achieves the above-described objects without destroying the environments.

A diaphragm for an electroacoustic transducer according to the present invention achieving the above-described objects includes a material including fibers taken out of young stems of bamboo grasses.

With thin cell walls of fibers and fiber bundles serving as long fibers, young stems of bamboo grasses enable the diaphragm of the electroacoustic transducer to have enhanced rigidity and increased internal loss without increasing density.

The present invention also includes an electroacoustic transducer using a diaphragm having the above-described structure. The electroacoustic transducer including such diaphragm can expand a reproducing band of a speaker particularly at a high frequency side and lower a high frequency peak in the reproducing band of the speaker.

The diaphragm for an electroacoustic transducer according to the present invention preferably includes paper made by mixing fibers taken out of bamboo grass young stems with wood pulp. In this case, excellent characteristics of a diaphragm can be obtained by mixing the fibers taken out of bamboo grass stems and the wood pulp of substantially the same weight.

A method of manufacturing a diaphragm for an electroacoustic transducer according to the present invention includes the steps of manufacturing paper by using a material including fibers taken out of young stems of bamboo grasses and forming the paper into a cone shape. The step of forming the paper into a cone shape is preferably carried out by thermal press molding the paper by using a mold having cavities corresponding to the shape of the diaphragm.

The foregoing and other objects, features, aspects and advantages of the present invention will become more apparent from the following detailed description of the present invention when taken in conjunction with the accompanying drawings.

However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DESCRIPTION OF THE PREFERRED EMBODIMENTS

One embodiment of the present invention will be described in the following with reference to the drawings.

Figure 1:
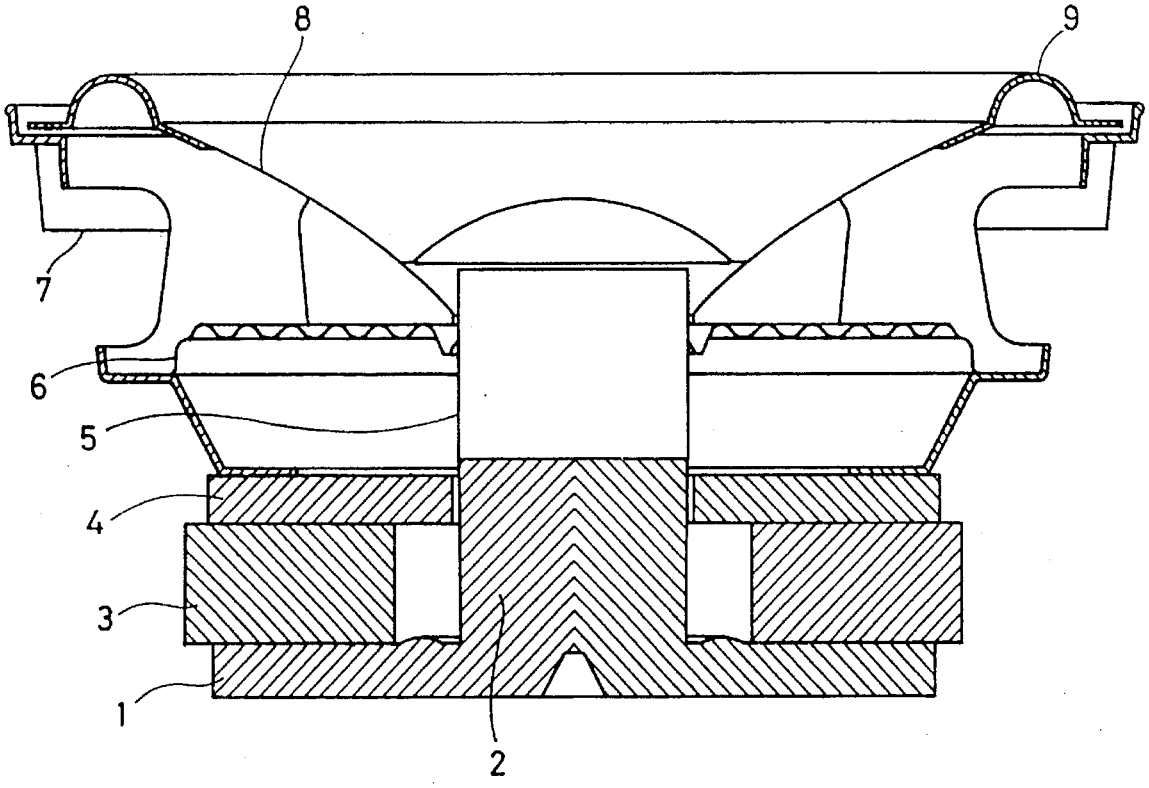
FIG. 1 is a sectional showing one example of a speaker to which a diaphragm for an electroacoustic transducer according to the present invention is applied.

FIG. 1 is a sectional side elevation view of an electrodynamic type speaker using a diaphragm according to one embodiment of the present invention. With reference to FIG. 1, the electrodynamic type speaker is provided with a center pole 2 disposed at the center of the upper surface of a supporting plate 1. A magnet 3 and an upper plate 4 are sequentially fixed on the supporting plate 1.

A voice coil 5 is supported, on the center pole 2 so as to reciprocate in the direction of the axis of the center pole 2, by a frame 7 with a damper 6 provided therebetween. Fixed to the top portion of the voice coil 5 is the inner peripheral portion of a diaphragm 8 which outer peripheral portion is coupled to the frame 7 by means of a ring-shaped edge 9.

The speaker of the present embodiment having the above-described structure uses a material including fibers taken out of young stems of bamboo grasses for such a diaphragm of an electrodynamic type speaker as described above.

A preferred embodiment of the present invention relates to a diaphragm of an electroacoustic transducer made of paper including pulped fibers taken out of young stems of *Sasa kurilensis* (Ruprecht) Makino et Shibata var. *kurilensis* and wood pulp, said diaphragm having a conical shape.

A method of manufacturing the diaphragm 8 of the present embodiment will be described in the following.

For forming the diaphragm 8, paper, a material of the diaphragm 8, is made by using fibers taken out of young stems of bamboo grasses as a raw material.

Then, the paper is thermal press molded by a mold having cavities in accordance with the configuration of the diaphragm 8 thereby forming a cone-shaped diaphragm 8 having a diameter of 10 cm and a thickness of about 0.5 mm, for example.

As a material for paper which is a raw material of the diaphragm 8, paper made by mixing fibers taken out of young stems of bamboo grasses and wood pulp at a predetermined ratio can replace the one made only by fibers taken out of young stems of bamboo grasses.

Although bamboo fibers are short in length which are included as a raw material in the diaphragm 8 of the present invention, growing young stems of bamboo grasses have a thin cell wall and fiber bundles made of gathered fibers in a vascular bundle and serving as long fibers. Such fibers of bamboo young stems included in the diaphragm 8 enables rigidity and internal loss characteristics thereof to be improved without increasing its density, thereby obtaining a highly balanced diaphragm.

As in the present embodiment, fibers taken out of young stems of bamboo grasses can be made into tightened paper for a diaphragm with high rigidity without requiring a step of beating wood pulp immersed in water for a long time, which step is necessary for manufacturing a diaphragm using only wood pulp. As a result, productivity of the diaphragm can be improved.

Obtaining wood pulp requires deforesting. Restoration of forest after deforesting takes an extremely long period of time. On the other hand, using young stems of bamboo grasses requires no parent bamboo grasses to be cut down but merely requires young stems to be cut. It is therefore possible to deforest the same place each year without affecting parent bamboo grasses. Using young stems of bamboo grasses is advantageous in terms of conservation of forest, that is, environmental protection.

Figure 2:
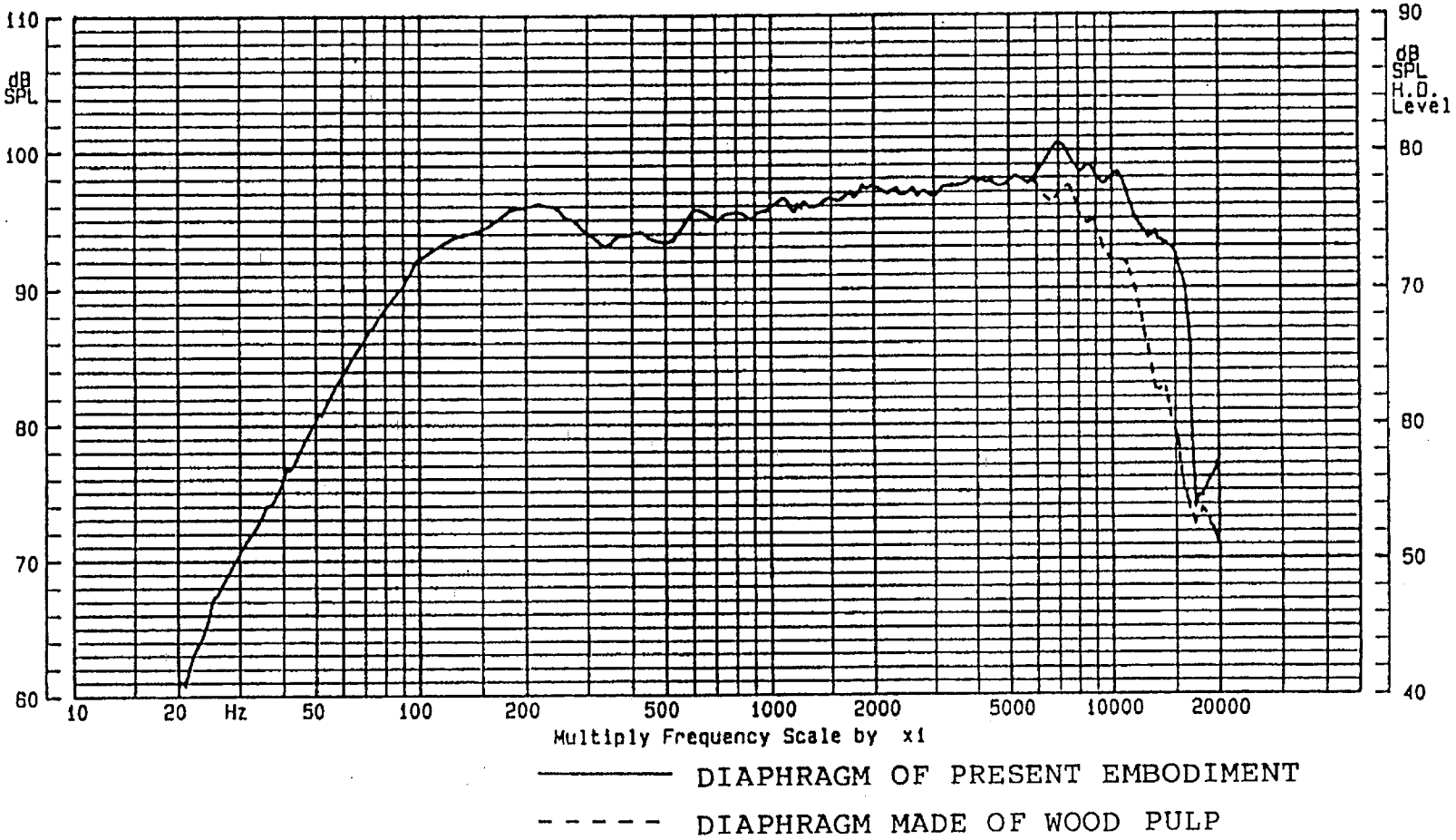
FIG. 2 is a diagram showing frequency characteristics of an electroacoustic transducer using a diaphragm according to one embodiment of the present invention.

Shown in FIG. 2 is a graph illustrating frequency characteristics of a diaphragm formed of paper made by mixing 50% by weight of fibers taken out of young stems of bamboo grasses and 50% by weight of wood pulp, and frequency characteristics of a diaphragm made of wood pulp, which graph demonstrates effects of the diaphragm according to the present embodiment.

Among bamboo grasses, bamboo grasses called "Chishima Sasa" distributed in the northernmost of Japan. They grow wild and gregarious in the northen part of Hokkaido. "Chishima Sasa" are different from the other bamboo grasses in that they have stems growing up to the maximum height of three meters, and branches spread out from a higher portion of the stems but not from a lower portion. The Chishima bamboo grasses used as a raw material of a diaphragm are cut down when they are in a young stem period (the period when the grasses grow most annually).

A diaphragm using paper made by mixing fibers taken out of young stems of Chishima bamboo grasses and wood pulp of 50% by weight each, has a density of 0.489, Young's Modulus of $2.41\times10^{10}$ dyn/cm$^2$ and internal loss of 0.06. Therefore, as shown in FIG. 2, the Young's Modulus is increased to enhance rigidity of the diaphragm and improve band characteristics, a high frequency band in particular. As a result, obtaining more excellent frequency characteristics with a wider band could be obtained than those of a conventional diaphragm.

Figure 3A:
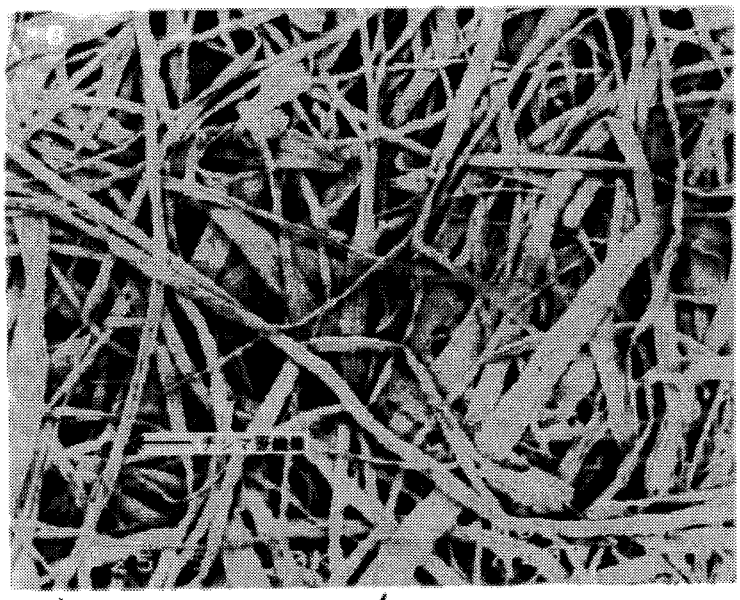
FIG. 3A is a photograph showing 100 times expansion of the state of entangled paper fibers constituting the diaphragm according to one embodiment of the present invention and FIG. 3B is a photograph showing 100 times expansion of entangled fibers of conventional wood pulp.
Figure 3B:
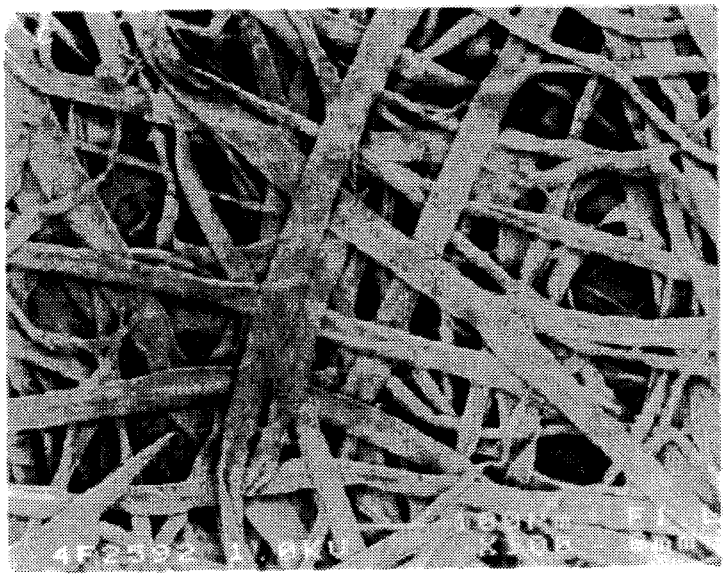

Shown in FIGS. 3A and 3B are photographs of 100 times expansion of paper fibers constituting the diaphragm according to the present embodiment and fibers of conventional wood pulp, respectively. As can be seen from FIG. 3A, the paper fibers of the present embodiment include thin fibers contained between thick wood fibers. On the other hand, the conventional wood pulp shown in FIG. 3B includes entangled wood fibers of approximately the same thickness. Because of the difference in fiber structure, the paper according to the present embodiment has larger Young's modulus than that of the conventional wood pulp to more easily prevent reduction of internal loss, resulting in improved speaker characteristics.

Although the present embodiment employs young stems of "Chishima Sasa", a kind of bamboo grass is not limited thereto. In addition, a mixture ratio of fibers taken out of young stems of bamboo grasses and wood pulp is not limited to the above-described ratio.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A diaphragm of an electroacoustic transducer made of paper including pulped fibers taken out of young stems of *Sasa kurilensis* (Ruprecht) Makino et Shibata var. *kurilensis* and wood pulp, said diaphragm having a conical shape.

2. The diaphragm of an electroacoustic transducer according to claim 1, wherein said paper of said diaphragm is made by mixing fibers taken out of young stems of *Sasa kurilensis* (Ruprecht) Makino et Shibata var. *kurilensis* and wood pulp, wherein the percentage by weight of *Sasa kurilensis* (Ruprecht) Makino et Shibata var. *kurilensis* is substantially equal to the percentage by weight of wood pulp.

3. An electroacoustic transducer, comprising a diaphragm made of paper including pulped fibers taken out of young stems of *Sasa kurilensis* (Ruprecht) Makino et Shibata var. *kurilensis* and wood pulp, a yoke, a magnet, and a voice coil, the magnet and voice coil being supported by the yoke, the diaphragm being fixed to the voice coil and the voice coil being between the magnet and the diaphragm, the diaphragm having a conical shape.

4. The diaphragm of an electroacoustic transducer according to claim 3, wherein said diaphragm is made by mixing fibers taken out of young stems of *Sasa kurilensis* (Ruprecht) Makino et Shibata var. *kurilensis* and wood pulp, wherein the percentage by weight of *Sasa kurilensis* (Ruprecht) Makino et Shibata var. *kurilensis* is substantially equal to the percentage by weight of wood pulp.

5. The diaphragm according to claim 1, wherein said diaphragm has a density of 0.489, a Young's Modulus of $2.41\times10^{10}$ dyn/cm$^2$, and internal loss of 0.06.

6. The electroacoustic transducer according to claim 3, wherein said diaphragm has a density of 0.489, a Young's Modulus of $2.41\times10^{10}$ dyn/cm$^2$, and internal loss of 0.06.

* * * * *